United States Patent [19]

Dziak

[11] 4,356,873

[45] Nov. 2, 1982

[54] CUTTER MOUNTING AND APPARATUS AND METHOD FOR A DRILL BIT

[75] Inventor: William A. Dziak, Maple Heights, Ohio

[73] Assignee: Mining Tools, Div. of Smith Int'l., Inc., Mentor, Ohio

[21] Appl. No.: 213,892

[22] Filed: Dec. 8, 1980

[51] Int. Cl.[3] ..... E21B 10/58; E21B 10/62

[52] U.S. Cl. ..... 175/410; 76/108 R; 407/118; 408/145; 408/705

[58] Field of Search ..... 175/410, 411; 76/108 R, 76/108 A, 101 E, DIG. 11; 408/705, 145, 57, 59; 407/118, 120

[56] References Cited

U.S. PATENT DOCUMENTS

| | | | |
|---|---|---|---|
| 1,956,233 | 4/1934 | Braun | 407/118 |
| 3,089,353 | 5/1963 | Craven | 76/108 R |
| 3,415,332 | 12/1968 | Bower, Jr. | 175/410 |
| 3,434,552 | 3/1969 | Bower, Jr. | 175/410 |
| 3,434,553 | 3/1969 | Weller | 175/410 |
| 3,434,554 | 3/1969 | Bower, Jr. | 175/410 |
| 3,487,514 | 1/1970 | O'Brien | 407/118 |

*Primary Examiner*—Stephen J. Novosad

*Attorney, Agent, or Firm*—Watts, Hoffmann, Fisher & Heinke Co.

[57] ABSTRACT

A drill assembly comprising a tool bit of the type including a slot at one end for receiving a cutting element. A positioning clip removably disposed in the slot and having a cutting element engagement structure for maintaining the position of the cutting element within the retainer clip, and drill body engagement structure for locating and maintaining the position of the clip within the slot of the tool bit.

11 Claims, 10 Drawing Figures

CUTTER MOUNTING AND APPARATUS AND METHOD FOR A DRILL BIT

TECHNICAL FIELD

The present invention relates generally to drill bits and in particular to a mounting apparatus and method for attaching a carbide cutting element to the body of a drill bit.

Drills used by the mining industry, such as roof drills, are used to bore holes in solid rock, for receiving explosive charges or anchor bolts. A conventional roof drill typically includes a cylindrical or rod-like body attachable at one end to a rotary power source. The other end of the drill usually includes a transverse slot in which a cutting element is fixed. The body may also include one or more passages that open near the cutting element and provide a means for removing the dust and chips generated during a drilling operation.

BACKGROUND ART

In prior art drill bits, the carbide cutting element is fixed to the drill body by a brazing or similar process. In past practice, a U-shaped copper clip or shim has been placed between the element and the drill body so that the legs of the clip extend between the planar sides of the cutting element and side surfaces defined by a transverse slot formed in the drill body. During the fabrication operation, the copper clip is brazed to the drill body thereby fusing the carbide element to the drill body.

In order to maximize drilling efficiency, the center line of the carbide element should be coincident with the rotational axis of the drill body. The prior art clip described above did not insure alignment between the cutting element and the drill body. Centering of the component parts was done during assembly by the workmen and as should be apparent, a great deal of time and effort was required. In general, the cutting element was aligned during the brazing operation by manually tapping the side of the element until it appeared visually aligned with the drill body. This tedious task was done while the components were heated to relatively high temperatures and moreover, was basically a trial and error operation, dependent primarily on the skill of the workmen. An error on the part of the workmen would produce a misalignment in the cutting element that would be manifested during drill use as an oversized hole, reduced drilling efficiency and possibly drill overheating. If the misalignment was recognized prior to shipment, costly reworking would be required to rectify the misalignment. If reworking did not correct the defective assembly, the entire drill bit would have to be scrapped.

DISCLOSURE OF INVENTION

The present invention provides a new and improved method and apparatus for fastening a cutting element to the drill body. The present invention is particularly useful in the assembly of drill bits used for mining and excavating. According to the invention, a cutting element retainer and shim is provided that automatically centers the cutting element within a transverse slot formed in the drill body and maintains the axial alignment of the two elements during the brazing operation. Hence, the present invention obviates the need for highly skilled workmen without sacrificing the quality of construction of the finished tool bit. In fact, tool bits constructed using the present invention, should generally be of higher quality than those constructed using the prior method. By removing the skill factor from the manufacture of the tool bit, the rework and scrap costs incurred with the prior method are substantially reduced, thereby reducing the overall cost of the tool bit.

In a preferred embodiment of the invention, the drill bit comprises a cylindrical drill body having a tapered drilling end and an opposite end attachable to a rotatable shaft. A transverse slot opened at the top and sides extends diametrically across the drilling end. A planar, plate-like cutting element, preferably constructed from carbide, is mounted within the slot and defines canted, leading cutting edges that extend above the tapered end surface on the drill body and further defines side cutting edges on opposite sides that extend beyond the circumferential surface of the drill body.

According to the invention, a cutting element retainer that also acts as a plum is provided for mounting the cutting element within the slot that automatically aligns and maintains the position of the cutting element within the drill body during assembly. In the preferred embodiment, the retainer comprises a pair of spaced side plates connected to each other in a parallel aligned relationship by a bridging section. When assembled, the side plates extend between planar side faces of the cutting element and side surfaces defined by the slot in the drill body. The bridging section is positioned between the bottom side of the cutting element and the base of the slot.

According to the invention, the retainer includes structure for engaging the cutting element and structure for engaging the drill body so that during assembly, the position of the cutting element relative to the drill body is maintained. The clip is preferably constructed of a non-ferrous material such as copper so that it forms a good fusion with the brazing alloy in the brazing process that serves to permanently attach the carbide cutting element to the drill body. Thus, the present invention provides a retainer that not only serves as a means for attaching the cutting element to the drill body but also serves as a means for locating and maintaining the alignment of the cutting element relative to the drill body during the attachment process.

In the preferred embodiment, the structure for engaging the cutting element comprises a projection formed on the bridging section that extends upwardly from the base of the slot and engages a notch formed on the bottom side of the cutting element. Preferably, the projection and notch are positioned centrally on the respective members and when assembled are thus located on the axis of rotation of the drill body. In order to locate the retainer relative to the drill body, each side plate includes an offset flange formed on the outer edge of the respective plate that is engageable with side edges defined on the drill body. The offset flanges are formed by bending side portions on each side plate so that tabs are formed that extend substantially orthogonal to the plane of the side plates along lines that are parallel to the axis of rotation of the drill bit.

It should be apparent that a novel method and apparatus for attaching a carbide cutting element to a drill bit such as a roof drill, is provided by the present invention. Thwe apparatus facilitates the assembly of the drill bit thereby reducing manufacturing cost without sacrificing the quality of the finished product.

Additional features and a fuller understanding of the invention will be obtained in reading the following detailed description made in connection with the accompanying drawings.

BEST MODE FOR CARRYING OUT THE INVENTION

Figure 1:
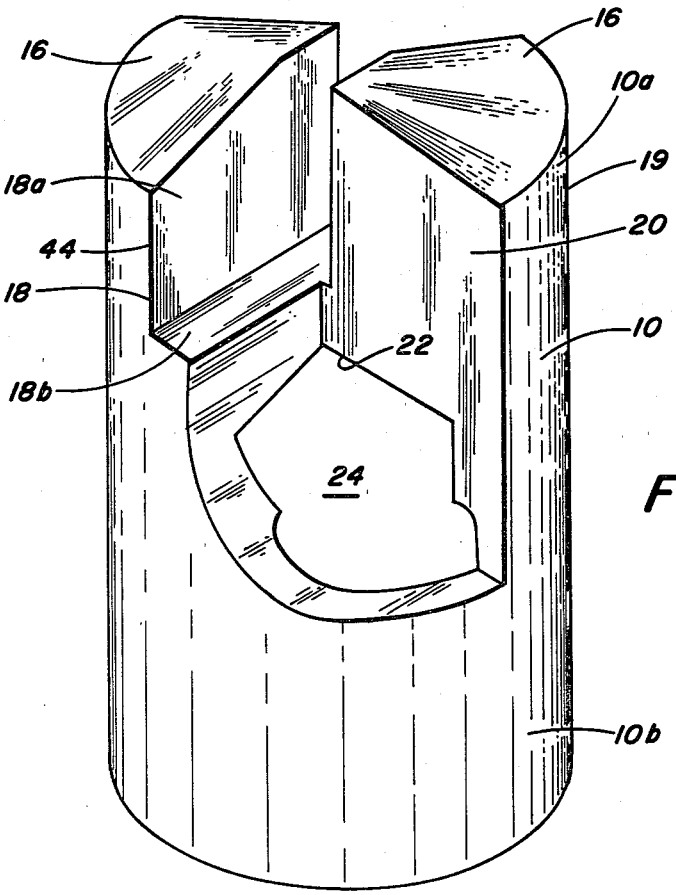
FIG. 1 is an exploded view of a drill bit assembly constructed in accordance with the preferred embodiment of the invention.

FIG. 1 illustrates the component construction of a mining roof drill constructed in accordance with the preferred embodiment of the invention. The drill comprises a drill body 10, a cutting element 12 and a retainer slip 14 for mounting the element 12 in the drill body 10.

Figure 8:
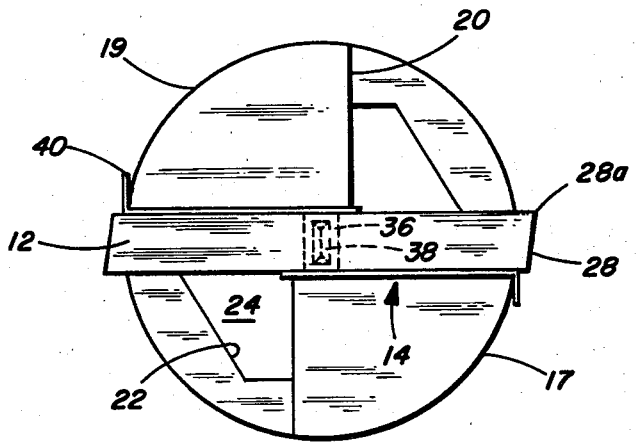
FIG. 8 is a top plan view of a drill bit constructed in accordance with the preferred embodiment of the invention.

The drill body 10 is generally cylindrical and includes a drilling end 10*a*. A lower end 10*b* is conventionally formed to couple to a rotatable drilling shaft (not shown). The drilling end 10*a* defines a tapered surfaces 16 and a transverse slot 18 that extends diametrically across the end of the drill body 10*a* and includes side surfaces 18*a* and a narrow base surface 18*b*. The ends of the slot open into the outer circumferential surface 19 of the drill body 10. The end of the drill also defines diagonally positioned cutaway portions 20 (see also FIG. 8) that form openings 22 that communicate with a central cavity 24 formed in the drill body 10. Although not shown, it will be recognized by those skilled in the art that the lower end 10*b* of the drill body includes an axial end opening that communicated with the central cavity 24.

Figure 9:
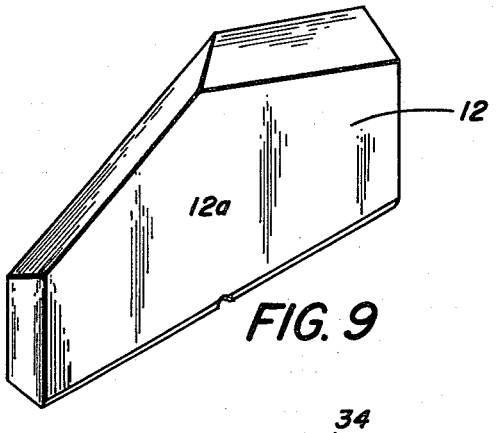
FIG. 9 is a generally perspective view of the cutting element removed from the drill bit of FIG. 1.
Figure 5:
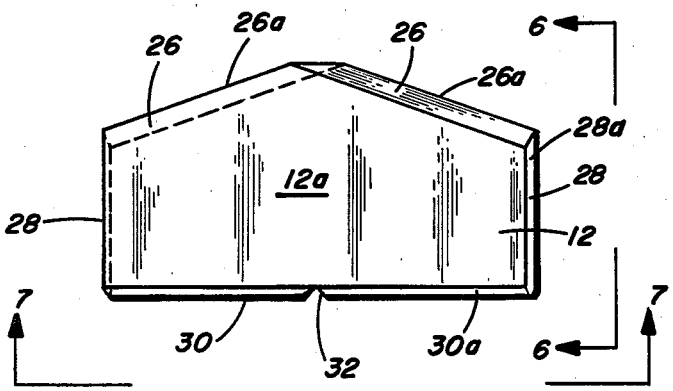
FIG. 5 is a side elevational view of a cutting element.
Figure 6:
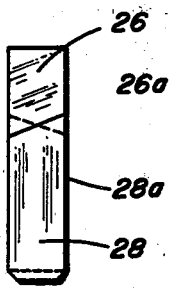
FIG. 6 is a view of the cutting element as seen along the line 6—6 in FIG. 5.
Figure 7:
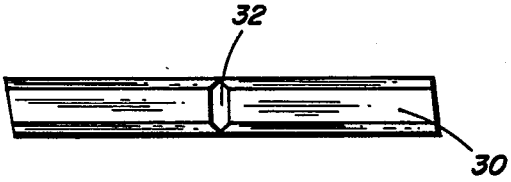
FIG. 7 is a view of the cutting element as seen along the line 7—7 in FIG. 5.

Referring also to FIGS. 5–7, the cutting element 12 is plate-like in configuration having two planar side faces 12*a* (FIG. 9) and is preferably constructed from a carbide related material. The carbide cutting element includes canted sides 26 that define leading cutting edges 26*a* and angled sides 28 that define side cutting edges 28*a*. Those skilled in the art will recognize that when the element 12 is positioned in the drill body 10, the cutting edges 26*a*, 28*a* extend beyond the respective drill body surfaces 16, 19 (see FIG. 8). The cutting element 12 also defines a bottom surface 30 having a triangularly shaped, transverse notch 32.

Figure 3:
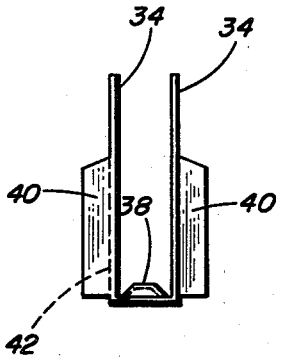
FIG. 3 is a view of the retainer as seen along the line 3—3 in FIG. 2.
Figure 2:
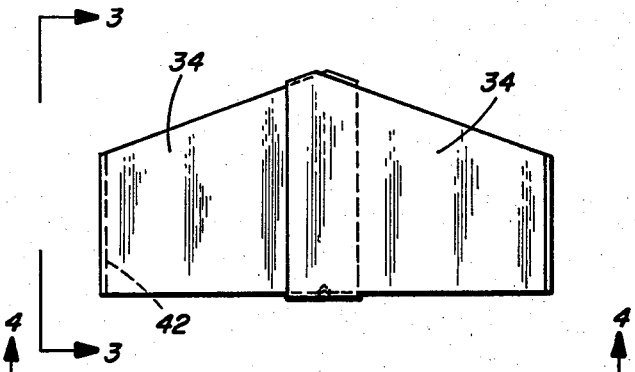
FIG. 2 is a side elevational view of a cutting element retainer constructed in accordance with the invention.
Figure 4:
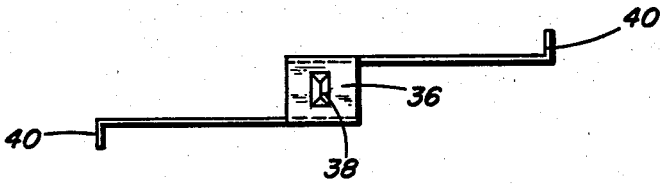
FIG. 4 is a view of the retainer as seen along the line 4—4 in FIG. 2.

According to the invention, mounting of the carbide cutting element 12 in the drill body 10 is facilitated by the retainer clip 14. The retainer 14 also acts as a shim for the cutting element 12 because the thickness of the cutting element is generally smaller than the width-wise dimension of the transverse slot 18. Referring to FIGS. 2–4, the retaining element 14 is a somewhat U-shaped sheet metal structure preferably constructed of a nonferrous, material such as copper. The retainer 14 comprises a pair of sheet metal, upstanding side plates 34 (as viewed in FIG. 2) that are joined together and maintained in a parallel aligned relationship by an interconnecting or bridging sheet metal section 36 (shown best in FIG. 4). The dimension of the bridging section 36 between the side plates 34 corresponds to the width or plate thickness of the cutting element 12. When the drill bit is assembled, the side plates 34 extend between and preferably frictionally engage the planar side surfaces 12*a* of the cutting element 12 and the side faces 18*a* of the transverse slot 18. When heated to the brazing temperature, 14, the side plates 34 join the carbide element 12 to the drill body 10 via the brazing material (not shown) upon cooling.

According to the invention, the retainer 14 includes structure to position and maintain the component parts of the drill assembly during the assembly operation, specifically during brazing or heating. In this way, the parts of the drill bit are maintained in proper alignment without requiring visual judgments or extraordinary skill on the part of the workman.

Figure 10:
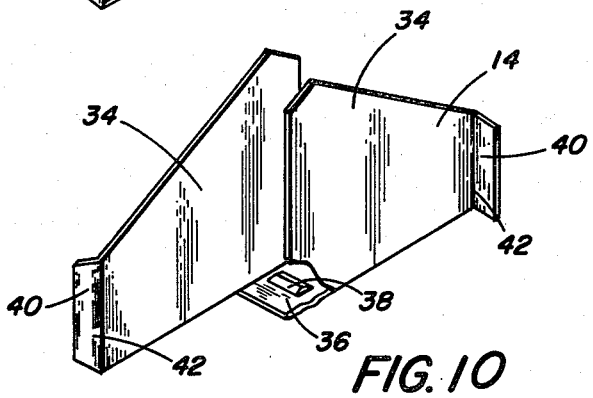
FIG. 10 is a generally perspective view of the retainer clip removed from the tool bit of FIG. 1.

In accordance with this feature of the invention, the retainer 14 includes a cutting element engaging projection 38 (FIG. 10) that extends upwardly from the bridging section 36 (as viewed in FIG. 1). The projection 38 is engageable with the notch 32 (see FIGS. 5 and 7) formed in the bottom surface 30 of the cutting element 12. As can be seen in Figures, the projection 38 and the notch 32 are similarly configured and contoured so that when the cutting element is engaged by the retainer 14, the lateral position of the cutting element 12 with respect to the retainer 14 is fixed. In the preferred embodiment, the notch 32 and projection 38 are centrally positioned on their respective elements so that when the drill bit is assembled the projection and notch 38, 32 will lie on the rotational axis of the drill body 10.

According to further aspects of this feature of the invention, the retainer 14 includes structure for engaging the drill body 10. This engaging structure preferably takes the form of flanges 40 disposed on the outer ends of each side plate 34. The flanges 40 are formed by bending a portion of each side plate 34 along an imaginary line 42 that is parallel to the rotational axis of the drill body 10. The wing-like tabs 40 are offset from the plane of the side plates 34, preferably extending at an angle of 90°.

The lateral positions of the flanges 40 on the side plates 34 are chosen so that an edge 44 (see FIG. 1) defined by the juncture of the drill body circumferential surface 19 and the slot surface 18*a* will engage the retainer 14 along the fold line 42. As most clearly shown in FIG. 8. the engagement between the opposite slot edges 44 and the flanges 40 locates and maintains the position of the retainer 14 in the slot 18 of the drill body 10.

It should be apparent that the engagements provided by the present invention between the retainer 14 and the drill body 10 and between the cutting element 12 and the retainer 14, insure that the drill bit is assembled in a properly aligned relationship. The engagements prevent lateral movements of the part during brazing and thus a high quality, accurately aligned drill bit assembly is provided by the invention.

Although the invention has been described with a certain degree of particularity it should be understood that those skilled in the art can make various changes to it without departing from the spirit or scope of the invention described and hereinafter claimed.

I claim:

1. A drill assembly comprising:
(a) a cylindrical drill body defining a tapered drilling end and an opposite end having attachment means for coupling said drill body to a source of rotation;
(b) said drilling end including an opened, transverse slot extending diametrically across said end;
(c) a planar cutting element mountable in said slot, defining leading, canted cutting edges along one side and side cutting edges substantially parallel to the axis of rotation of said drill body along two opposed sides;
(d) a non-ferrous, retainer for attaching said cutting element to said drill body comprising spaced, planar side plates connected to each other in a parallel aligned relationship by a bridging section;
(e) said retainer including cutting element engagement means for maintaining the position of said cutting element within said retainer and a drill body engagement means for locating and maintaining the position of said retainer within said transverse slot during assembly of said drill bit.

2. The apparatus of claim 1 wherein said drill body further defines a central cavity that opens into said opposite end and cutaway portions on said drilling end that form passages near said cutting element that communicate with the central cavity.

3. The apparatus of claim 1 wherein said cutting element engagement means comprises a projection formed on the bridging section of said retainer engageable with a notch formed in said cutting element and said drill body engagement means comprises offset flanges formed on the outer side edges of the side plates of said retainer that are engageble with side edges on said drill body.

4. A method for positioning a cutting element within a recess of a tool bit, and for attaching the cutting element to the tool bit comprising the steps of:
(a) providing a clip for retaining the cutting element;
(b) inserting the cutting element into the clip;
(c) moving the cutting element within the clip until a positioning structure of the clip engages a cooperating portion of the cutting element;
(d) inserting the clip into the tool bit recess;
(e) relocating the clip within the recess until a clip locating structure engages a cooperating portion of the tool bit;
(f) attaching the tool bit to the cutting element.

5. A method for positioning a cutting element within a slot of a tool bit and for attaching the cutting element to the tool bit comprising the steps of:
(a) providing a generally U-shaped clip for receiving and retaining the cutting element;
(b) inserting the cutting element into the clip;
(c) moving the cutting element within the clip to engage a positioning projection on the clip with a cooperating notch on the cutting element;
(d) aligning locating tabs on the clip with cooperating edges of the tool bit and inserting the clip into the slot with the cutting element thereby properly aligned for attachment to the tool bit;
(e) brazing the tool bit to the cutting element.

6. A method for positioning plate-like cutting element within a slot on a cylindrical tool bit and for attaching the cutting element to the tool bit including the steps of:
(a) providing a U-shaped clip;
(b) aligning locating structure on the clip with edges defined by the intersection of the slot and the tool bit outer surface;
(c) inserting the clip into the slot;
(d) inserting the cutting element into the clip;
(e) relocating the cutting element within the clip to engage a positioning portion of the clip with a cooperating portion of the cutting element thereby positioning the cutting element within the tool bit for attachment;
(f) brazing the cutting element to the tool bit.

7. A tool bit assembly comprising:
(a) a generally plate-like cutting element having a cutting edge and an opposite edge including a positioning structure;
(b) a positioning clip including generally parallel side elements having clip locating structures, an interconnecting member joining the side elements in a spaced relationship corresponding to a width-wise dimension of the cutting element, and cutting element engagement means cooperating with the cutting element positioning structure to locate and maintain the position of said cutting element within said clip; and
(c) a tool bit including a slot at one end for receiving said positioning clip and defining clip engagement means cooperating with the clip locating structures to position and maintain the positioning clip within said slot.

8. A tool bit assembly comprising:
(a) plate-like cutting element including longitudinal parallel sides, at least one cutting face, a face obverse to the cutting face, and a notch on the obverse face;
(b) a brazing clip including generally parallel side plates terminating in tabs oriented at an angle to the side plates, an interconnecting member joining the side plates in a spaced relationship corresponding to a dimension between the parallel cutting element sides, and a projection positioned on the interconnecting member; and
(c) a cylindrical tool bit including a slot on one end, the slot intersecting a circumferential surface of the tool bit to define locating edges.

9. A meltable clip for positioning a cutting element within a slot on a tool bit prior to attaching the cutting element to the tool bit comprising:
(a) generally parallel side plates, at least one side plate including a tab portion oriented at an angle to the associated side plate and engageable with an edge surface on said tool bit;
(b) an interconnecting member joining the side plates in a spaced relationship corresponding to a width-wise dimension of the cutting element; and
(c) positioning structure frictionally engageable with the cutting element and operative to locate and maintain the position of said element in said clip.

10. A clip for positioning a cutting element within a slot on a tool bit when attaching the cutting element to the tool bit comprising:
(a) two side plates defining generally parallel planes;
(b) an interconnecting member joining the side plates in a spaced relationship corresponding to a width-wise dimension of the cutting element;

(c) a tab formed on a edge of at least one of the side plates, the tab being oriented at an angle to the plane of said side plate; and (d) a positioning projection for engaging a cooperating recess of the cutting element to be positioned.

11. A tool bit assembly comprising:

(a) a tool bit including an elongated cylindrical body having a slot at one end adapted for receiving a retainer clip member, (b) said retainer clip member being made from a meltable metallic material having a generally U-shaped configuration defined by oppositely disposed side plates interconnected by a bridging section having a width-wise dimension so as to be positioned within said slot, (c) said retainer clip member including cutting element engagement means for maintaining the position of said cutting element within said retainer clip member, and (d) a drill body engagement means made from and projecting downwardly from said bridging member and adapted for co-acting engagement with notch means in said cutting element for locating and maintaining the position of said retainer clip member within said slot upon assembly of said tool bit.

* * * * *